United States Patent [19]

Hendrickson

[11] 3,943,619

[45] Mar. 16, 1976

[54] PROCEDURE FOR FORMING SMALL WIRES

[75] Inventor: Paul E. Hendrickson, Wayne, Pa.

[73] Assignee: Raymond Boyd Associates, Broomall, Pa.

[22] Filed: Oct. 2, 1974

[21] Appl. No.: 511,354

[52] U.S. Cl. ..... 29/423; 29/419 R; 29/424; 29/DIG. 11

[51] Int. Cl.[2] ..... B23P 17/00

[58] Field of Search ..... 29/419, 423, 424, DIG. 11; 72/46

[56] References Cited

UNITED STATES PATENTS

| | | | |
|---|---|---|---|
| 2,077,682 | 4/1937 | Everett | 29/417 X |
| 2,215,477 | 9/1940 | Pipkin | 29/423 X |
| 2,718,049 | 9/1955 | Prache | 29/609 |
| 3,277,564 | 10/1966 | Webber et al. | 29/423 X |
| 3,394,213 | 7/1968 | Roberts et al. | 29/419 X |
| 3,540,114 | 11/1970 | Roberts et al. | 29/419 |
| 3,591,915 | 7/1971 | Roberts et al. | 29/423 X |
| 3,807,026 | 4/1974 | Takeo | 29/419 R |

*Primary Examiner*—Victor A. DiPalma
*Attorney, Agent, or Firm*—Charles F. Duffield

[57] ABSTRACT

A procedure for drawing ultrafine wires is disclosed which incorporates the steps of inserting a core wire of a selected material into a plurality of telescoped sacrificial sheaths, welding the ends of the core wire to the sheath and successively drawing the combination down to a predetermined diameter. The outside sheath is sacrificed by etching to free the proportionately reduced core wire. The core wire may be initially covered with Teflon to aid in the reduction and the Teflon is removed by exposure to heat.

2 Claims, 10 Drawing Figures

PROCEDURE FOR FORMING SMALL WIRES

BACKGROUND OF INVENTION

A great need exists today for wires of extremely small diameter or what are known as ultrafine wires. Such industries as the microelectronics industry require wires of a diameter of something substantially less than .001 of an inch. Such ultrafine wires are usually required to be of one of the precious metals such as gold, silver, platinum, etc.

One common method of producing fine wires is by the well known drawing technique. This technique has been highly refined and, in the case of the extremely fine wires, diamond dies have been employed. In this technique, a single strand of the wire material is successively reduced through dies. As the diameter continues to reduce, the technique becomes more tedious as the wire has less and less strength and drawing capability due to its extremely reduced diameter. As a practical matter, wires below .001 inches in diameter cannot be produced by this single strand-drawing technique. For a great number of applications, wires of this diameter are not small enough.

A further refinement in the single strand drawing technique has evolved in the state of the art. In this technique, a core wire of the particular metal from which the wire is to be formed is encased in a sacrificial sheath. The core and the sheath are then reduced as a unit to a predetermined small diameter. Thereafter, the sheath is removed from the wire by various sacrificial methods such as etching in an acid leaving the core wire.

In the core wire-sacrificial sheath technique, the ratio of the diameter of the core wire to the diameter of the sheath will remain constant through the successive reductions. Thus, for example, if the core wire is 1/10 the diameter of the sheath and the diameter of the sheath is reduced to 1/20 of its initial diameter, the core wire will likewise be reduced to 1/20 of its diameter. Accordingly, much greater reductions in the core wire are available by this technique since the overall sheath-core combination may be reduced by the conventional drawing technique to the same small diameters that the single strand of the core material itself could be reduced.

Theoretically, extremely large ratios of sheath diameter to core wire ratios could be utilized to produce core wires of diameter approaching microscopic dimensions. However, practical limitations exist in finding sheath material that will have an extremely large outside diameter and the requisite extremely small inside diameter of sufficient accuracy to permit practical use of the technique. Today sheath material which may be used in this technique can only be obtained with a ratio no greater than ten to one. This practical limitation on the sheath material results in a limitation on the smallest diameter to which the core wire can practically be drawn to a level of .001 of an inch. Attempts to draw the sheath-core combination to produce core wires of dimensions less than this becomes impractical or impossible.

OBJECTS AND SUMMARY OF INVENTION

It is an object of the present invention to provide improvements in methods for producing ultrafine wire by the core-sacrificial sheath drawing technique.

It is a further object of the present invention to provide a method for fabricating a sacrificial sheath for use in the core-sacrificial sheath drawing technique which provides greater sheath to core ratios.

The foregoing objects are carried out in accordance with the present invention by providing a composite sheath which is formed of a plurality of telescoped sheaths. The smallest or inside sheath is chosen to have an inside diameter corresponding to the core wire. Successive outer sheaths are telescoped one upon another until the required outside diameter is obtained to provide the necessary sheath to core wire ratio.

Once the sheaths have been telescoped together, they are pulled through a drawing die to mechanically bond the sheaths one to another. Thereafter, a Teflon coated core wire is inserted into the composite sheath. The core wire and sheaths are further bonded together by welding at the ends of the sheath and core combination.

The sheath-core wire combination is successively reduced and annealed until a predetermined diameter has been reached. Thereafter, the sheath material is removed by an etching process to leave remaining the Teflon coated reduced core wire. The Teflon is removed from the core wire by exposure to heat at a time and temperature sufficient to evaporate the Teflon.

Other objects and advantages of the present invention will become apparent to those skilled in the art from the detailed description thereof which follows taken in conjunction with the drawing.

DETAILED DESCRIPTION OF INVENTION

Figure 1:
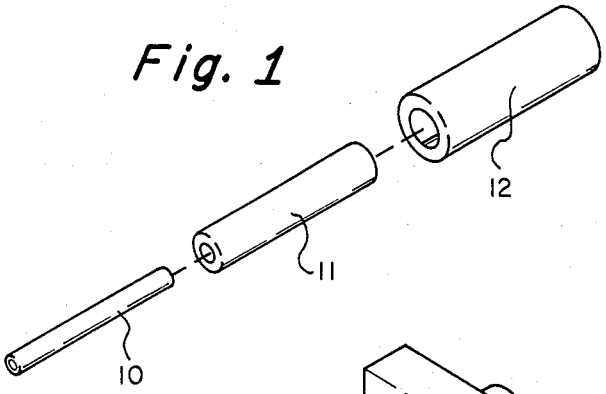
FIG. 1 is a perspective illustration of the sheaths prior to being telescoped.
Figure 2:
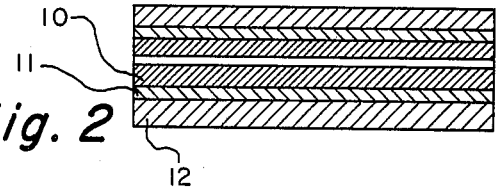
FIG. 2 is a sectional view of the sheaths of FIG. 1 in telescoped position.

The method steps employed in forming ultrafine wire in accordance with the present invention are pictorially shown in FIGS. 1–10 of the drawing. Initially, the sheath material is formed of three telescoped sheaths as shown in FIGS. 1 and 2. In the particular embodiment of the present invention, the inner sheath 10 has an inside diameter of .013 inches and an outside diameter of .107 inches. The inner sheath 11 is of .112 inside diameter and .240 outside diameter and the outside sheath 12 is of .245 inside diameter and .380 outside diameter. Thus, the sheath has .005 inches clearance and can be easily telescoped one into another as shown in FIG. 2.

Figure 3:
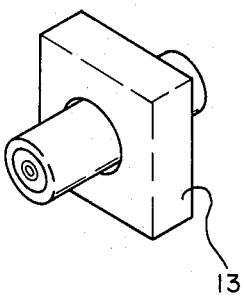
FIG. 3 illustrates the mechanical bonding of the sheaths.

After the sheaths have been telescoped one into another as shown in FIG. 2, they are pulled through a drawing die as shown in FIG. 3. The drawing die 13 reduces the sheaths to an overall outside dimension of .375 inches. Accordingly, the outer sheath 12 which was theretofore .380 inches is reduced by .005 inches. The result is that the three sheaths are compressed one upon another and become mechanically bonded together. After the drawing operation illustrated in FIG. 3, the composite sheath is cleaned and degreased.

The next step in the method is the preparation of the core wire. The core wire to be utilized is a matter of choice but usually is one of the precious metals such as gold, silver, platinum, etc.

The initial step in the preparation of the core wire is to draw the core wire to a diameter of .010 inches. Thereafter, the core wire is coated with Teflon (tetrafluoroethylene polymer).

Figure 4:
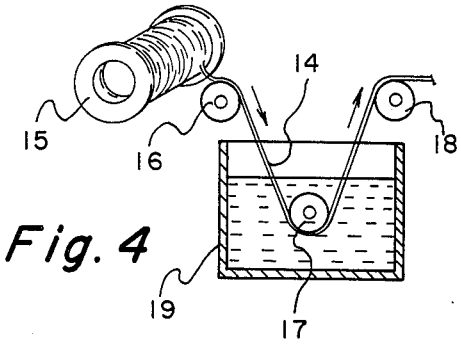
FIG. 4 illustrates the step of Teflon coating the core wire.

One method of coating the core wire with Teflon is shown in FIG. 4. The core wire 14 is initially disposed on a spool 15. The wire 14 is pulled over pulleys 16–18 which pass the wire through a tank 19 which contains Teflon in a liquid state. The coated wire is then permitted to dry. The resultant Teflon coating on the wire produces a diameter for the core material slightly smaller than the .013 inches inside diameter of the sheath.

Figure 5:
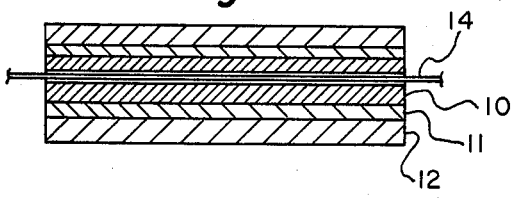
FIG. 5 illustrates the composite core wire-sheath assembly before drawing.
Figure 6:
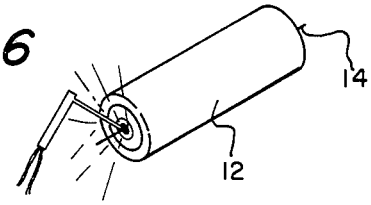
FIG. 6 illustrates the method of bonding the core wire and sheaths.

The next step in the fabrication technique is to cut a piece of the Teflon coated wire of length slightly in excess of the sheath and insert the wire into the inside diameter of the sheath as indicated in FIG. 5. Next, both ends of the core wire are welded to the inner sheath 10 as illustrated in FIG. 6. One of the ends of the core wire within the sheath insures against loss of the Teflon from the sheath during the successive drawing operations which are to follow.

Figure 7:
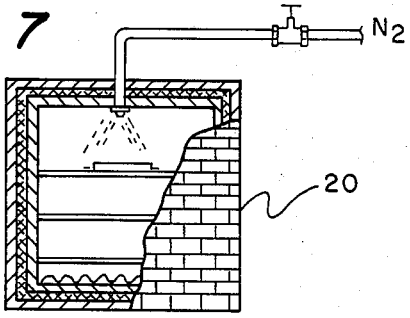
FIG. 7 illustrates the annealing method step.

The next following in the fabricating procedure of the present invention, as illustrated in FIG. 7, is to anneal the assembly of the core wire and sheath. The assembly is placed in an oven 20. The oven is maintained at a temperature of approximately 572°F. and is maintained in a nitrogen atmosphere. The core-sheath assembly is maintained in the oven 20 for approximately 15 minutes which is sufficient to heat the assembly and anneal it for the drawing operations to follow.

Figure 8:
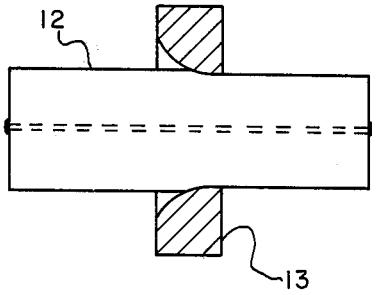
FIG. 8 illustrates the drawing die employed in the method.

The assembly is now subjected to the first drawing sequence as shown in FIG. 8. The assembly begins at .375 inches and is drawn in three successive draws to .307 inches. The drawing steps are in accordance with the B & S gauge or size reductions. Each of the steps of reduction in accordance with B & S scale results in a reduction in the cross sectional area of the wire of 20% per step. The B & S gauge or size reduction dimensions are familiar to those skilled in the art and, therefore, it is not believed necessary to set forth each of the specific diameters to which the wire is drawn in each of the repetitive size reduction steps.

Following the first reduction sequence, the core-sheath combination is again annealed. The annealing step is at the same temperature, atmosphere and time as the initial annealing step.

The sheath and core combination is again subjected to three reduction steps ending at .250 inches. The annealing procedure as above described is again repeated. Thereafter, four successive B & S reductions are accomplished to .187 inches and the annealing procedure is repeated. Further reduction occurs in five reduction steps to .125 with a final annealing step.

The .125 inch core-sheath assembly may now be drawn through as many reduction steps as required to arrive at a core wire diameter desired. For example, if 48 sequential reductions are accomplished to produce an outside sheath diameter of .005 inches, the resultant core due to the 37.5 to 1 ratio will be reduced to .00013 inches. It has been found that, in accordance with the present invention, it is possible to draw the sheath to as low as .00147 inches. This results in a reduction in the core material to one micron or .0000393 inches.

Figure 9:
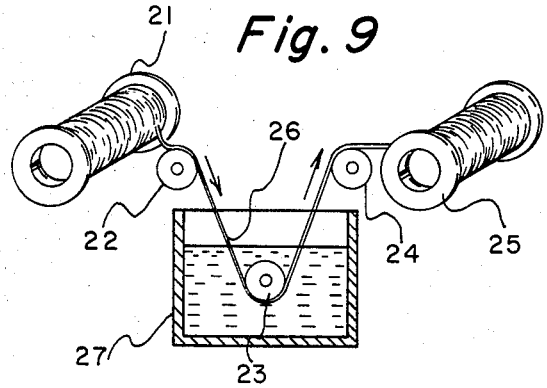
FIG. 9 illustrates the method of removing the sheath material.
Figure 10:
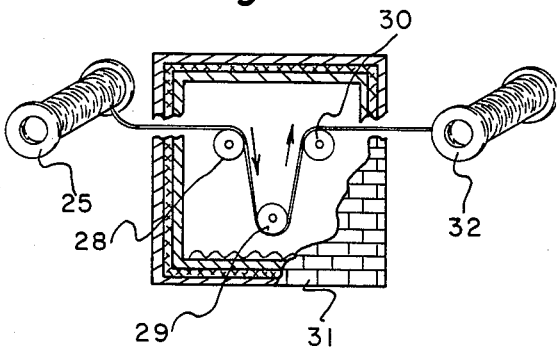
FIG. 10 illustrates the step of removing the Teflon coating.

The procedure in accordance with the method of the present invention utilized for removing the copper sheath from the core wire is pictorially illustrated in FIG. 9 of the drawing. The combined core and copper sheath is rolled upon a roll 21 at the end of the final drawing operation. The combined core and sheath 26 is passed over rollers 22–24 which convey it through a tank 27 containing an acid bath. The wire is exposed to the acid bath just long enough to completely etch off the copper sheath down to the Teflon coating on the core wire. Thereafter, the wire is passed through a water rinse (not shown) and air dried prior to being taken up on a takeup roll 25. In a preferred embodiment, nitric acid is employed to etch the copper. Other such etching means as electrolysis could also be used.

The final step employed in the procedure in accordance with the present invention is the removal of the Teflon from the core wire. This method step is pictorially shown in FIG. 10 of the drawing. The Teflon coated core wire is passed from the spool 25 over pulleys 28–30 disposed within an oven 31 and rewound upon a final spool 32. The oven 31 is maintained at a temperature of approximately 600° F. The passage time of the core wire through the furnace is approximately 10 minutes. This time exposure to the 600° F temperature is sufficient to cause the Teflon coating to be completely evaporated from the core wire. The resultant wire is then wound upon a spool 32 and is completely free of the sheath material and Teflon coating.

The foregoing description of the method for fabricating ultrafine wires has been made in respect to certain embodiments of the invention as disclosed in the drawings and specification and it is to be understood that the invention is capable of modifications beyond those disclosed. Therefore, changes in the disclosed method of fabricating fine wires may be made without departing from the spirit and scope of the invention as defined in the appended claims.

I claim:

1. In the method of forming ultrafine wires of a given material including the steps of forming a core wire of a given material, encasing the core wire within an elongate sheath of drawable sacrificial material, successively drawing the sheath to a predetermined reduced cross section to proportionately reduce the core wire and thereafter remove the sheath material by sacrificial methods leaving the proportionately reduced core wire, the improvements in forming a sheath to provide increased sheath to core wire ratios resulting in greater core wire reductions comprising:

telescoping a plurality of elongate sheaths one within another to form an overall sheath having an inside and outside diameter required to establish the desired reduction ratio.

2. The method of claim 1 including the step of drawing the plurality of telescoped sheaths to a predetermined reduced cross section prior to insertion of the core wire to bond the sheaths one to another.

* * * * *